US011690439B2

(12) United States Patent
Neal

(10) Patent No.: US 11,690,439 B2
(45) Date of Patent: Jul. 4, 2023

(54) PORTABLE, INTERCHANGEABLE AND MULTIPURPOSE BACKPACK PROVIDING ENHANCED STORAGE AND A CARRIER FOR HOLDING A CHILD

(71) Applicant: Quinton Neal, Austin, TX (US)

(72) Inventor: Quinton Neal, Austin, TX (US)

( * ) Notice: Subject to any disclaimer, the term of this patent is extended or adjusted under 35 U.S.C. 154(b) by 81 days.

(21) Appl. No.: 17/318,965

(22) Filed: May 12, 2021

(65) Prior Publication Data

US 2021/0274919 A1 Sep. 9, 2021

Related U.S. Application Data

(60) Provisional application No. 63/100,417, filed on Mar. 6, 2020.

(51) Int. Cl.

| | |
|---|---|
| ***A47D 13/02*** | (2006.01) |
| ***A45F 4/02*** | (2006.01) |
| ***A45F 3/04*** | (2006.01) |

(52) U.S. Cl.

CPC ..... *A45F 4/02* (2013.01); *A45F 3/04* (2013.01); *A47D 13/025* (2013.01); *A45F 2003/045* (2013.01)

(58) Field of Classification Search

CPC ..... A47D 13/025
USPC ..... 224/581–583
See application file for complete search history.

(56) References Cited

U.S. PATENT DOCUMENTS

| | | | | |
|---|---|---|---|---|
| 9,295,341 | B2 | 3/2016 | Sonnenberg | |
| 9,439,516 | B2 * | 9/2016 | Workman | A47D 13/025 |
| 10,986,911 | B2 * | 4/2021 | Cotirla | A45F 3/04 |
| 2001/0030210 | A1 * | 10/2001 | Donine | A47D 13/025 224/160 |
| 2007/0045370 | A1 * | 3/2007 | Hsieh | A45F 3/04 190/110 |
| 2007/0175941 | A1 * | 8/2007 | Berry | A45C 13/02 224/583 |
| 2017/0238722 | A1 | 8/2017 | Flaunty et al. | |
| 2018/0008024 | A1 * | 1/2018 | Barton | A45F 3/04 |

FOREIGN PATENT DOCUMENTS

| | | | | |
|---|---|---|---|---|
| JP | H0679322 U | * | 11/1994 | |
| WO | WO-2004100706 A1 | * | 11/2004 | A45F 3/047 |

* cited by examiner

*Primary Examiner* — Scott T Mcnurlen
(74) *Attorney, Agent, or Firm* — Hulsey P.C.

(57) ABSTRACT

A backpack providing enhanced storage and a carrier for holding a child is disclosed. The backpack includes a back plate having a receptacle for storing items. Further, the back plate includes connecting straps drawing through strap openings. The back plate includes shoulder straps. The backpack includes a face plate having a receptacle for storing items. The face plate connects to the back plate. The backpack further includes a front plate having front plate strap connectors and top straps. A user puts on the first shoulder straps over his shoulder to use the back plate as a backpack. Further, the user connects the front plate strap connectors to the connecting straps, and the top straps to the first shoulder straps creating a child receiving portion. The user places a child in the child receiving portion between his body and the front plate for use as a carrier for holding a child.

20 Claims, 12 Drawing Sheets

PORTABLE, INTERCHANGEABLE AND MULTIPURPOSE BACKPACK PROVIDING ENHANCED STORAGE AND A CARRIER FOR HOLDING A CHILD

The present application claims the benefit of U.S. Provisional Application No. 63/100,417, filed Mar. 12, 2020; all of which is incorporated herein by reference.

FIELD OF THE DISCLOSURE

The present invention generally relates to portable and convertible backpacks and/or child carriers. More specifically, the present invention relates to a portable, interchangeable and multipurpose backpack providing enhanced storage and a carrier for holding a child.

BACKGROUND OF THE DISCLOSURE

Backpacks are commonly used to carry articles or items. Backpacks are preferred as they do not occupy the hands of a user and do not strain the user's hands. Young mothers carrying children face considerable physical prowess and balance challenges in carrying both the child and the backpack.

Several attempts have been made in the past to address the above problem by combining backpacks and child carriers. One such example is disclosed in a U.S. Pat. No. 9,295,341, entitled "Convertible Bag and Child carrier" ("the '341 Patent"). The '341 Patent discloses a convertible bag with storage compartments, pockets, and bottle compartments for carrying diapers, bottles, childcare supplies, or other general items. The bag can convert into a sling for carrying a child. The storage compartments, pockets, and bottle compartments of the convertible bag can still be accessed by a user even when a child is being carried in the converted sling configuration.

Another example is disclosed in a United States Publication No. 20170238722, entitled "A Baby Carrier" ("the '722 Publication"). The '722 Publication discloses a multi-functional baby carrier that transitions seamlessly from one mode to another to allow the carrying of a child from new-born baby through to a toddler wherein the main body forms an adjustable seat width position to address ergonomic concerns when in a particular carrying mode. The main body portion also comprises a hands through pouch configured to allow a wearer to pass their hands through for additional support when carrying the child. The insert includes an adjustable length back support and is configured to engage with the main body of a multi-functional baby carrier without requirement of separate fasteners to retain the insert within the main body of the multi-functional baby carrier.

Although the above discussed disclosures are successful in combining backpacks and child carriers, they have few problems. For example, the user must carry a separate bag for storing the child carriers in addition to the backpack, which can be cumbersome. Further, they are not easy to install and uninstall.

Therefore, there is a need for an improved backpack that has the features of a backpack and a child carrier and requires no separate bags to carry them.

BRIEF SUMMARY OF THE DISCLOSURE

It is an object of the present invention to provide a backpack having the features of a backpack and a child carrier and that avoids the drawback of known convertible bag and child carriers.

It is another object of the present invention to provide a portable, interchangeable and multipurpose backpack providing enhanced storage and a carrier for holding a child.

It is another object of the present invention to provide a backpack having the features of a backpack and a child carrier that allows the user to have balance and control while carrying the backpack and the child.

In order to overcome the limitations here stated, the present invention provides a portable, interchangeable and multipurpose backpack. The backpack includes a back plate, a face plate and a front plate. The back plate includes a first receptacle for storing articles or items. The back plate includes a first access section such as a cover flip that allows access to the first receptacle. The back plate includes shoulder straps that allow a user to put on the back plate as a backpack. Further, the back plate includes strap openings for receiving connecting straps for connecting the front plate to the back plate.

Further, the back plate includes a face plate receiving section. The face plate receiving section receives the face plate, via a zipper, for example. The face plate includes a second receptacle for storing articles or items. The face plate includes a second access section such as a cover flip that allows access to the second receptacle. The face plate includes shoulder straps that allow a user to put on the face plate as a (separate) backpack.

The front plate includes straps that connect to the back plate. The front plate connects to the back plate and allows it to be used as a child carrier with the back plate. Here, the user The user places a child in a child receiving portion i.e., between his body and the front plate for use as a carrier for holding a child.

In one advantageous feature of the present invention, each of the back plate, the face plate and the front plate includes one or more portable storage compartments. The portable storage compartments allow to store smaller items.

In another advantageous feature of the present invention, the user can interchange the back plate, the face plate and the front plate and use them as a backpack or child carrier depending on the need. In one implementation, the user can use the back plate alone as a backpack. In another implementation, the user can use the face plate alone as a backpack. Additionally, the user can connect the face plate to the back plate and use them as a single (combinational) backpack with multiple receptacles i.e., first and second receptacles. Further, the user can connect the front plate to the back plate or the face plate to convert the backpack for use as a backpack and a child carrier.

In another advantageous feature of the present invention, the user folds and stores the front plate in one of the back plate and the face plate thereby saving space when it is not needed. This allows the backpack to be portable and easy to carry without the need for separate bags.

Features and advantages of the subject matter hereof will become more apparent in light of the following detailed description of selected embodiments, as illustrated in the accompanying FIGUREs. As will be realized, the subject matter disclosed is capable of modifications in various respects, all without departing from the scope of the subject matter. Accordingly, the drawings and the description are to be regarded as illustrative in nature.

BRIEF DESCRIPTION OF THE DRAWINGS

The present subject matter will now be described in detail with reference to the drawings, which are provided as illustrative examples of the subject matter so as to enable those skilled in the art to practice the subject matter. It will be noted that throughout the appended drawings, like features are identified by like reference numerals. Notably, the FIGUREs and examples are not meant to limit the scope of the present subject matter to a single embodiment, but other embodiments are possible by way of interchange of some or all of the described or illustrated elements and, further, wherein.

DETAILED DESCRIPTION OF THE EMBODIMENTS

Figure 1:
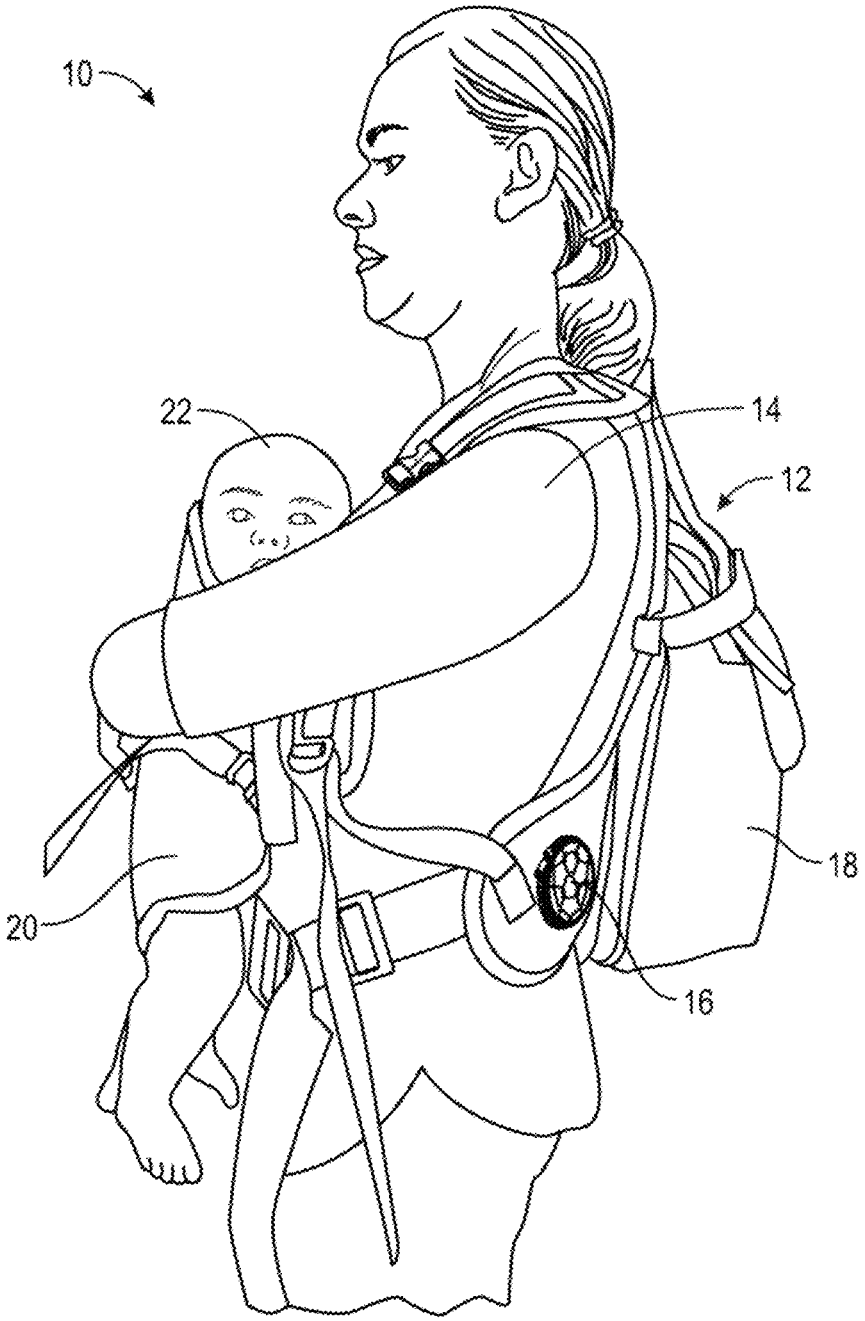
FIG. 1 illustrates an environment of a portable, interchangeable and multipurpose backpack worn by a user, in accordance with one embodiment of present invention.

The detailed description set forth below in connection with the appended drawings is intended as a description of exemplary embodiments in which the presently disclosed subject matter may be practiced. The term "exemplary" used throughout this description means "serving as an example, instance, or illustration," and should not necessarily be construed as preferred or advantageous over other embodiments. The detailed description includes specific details for providing a thorough understanding of the presently disclosed backpack. However, it will be apparent to those skilled in the art that the presently disclosed subject matter may be practiced without these specific details. In some instances, well-known structures and devices are shown in functional or conceptual diagram form in order to avoid obscuring the concepts of the presently disclosed backpack.

In the present specification, an embodiment showing a singular component should not be considered limiting. Rather, the subject matter preferably encompasses other embodiments including a plurality of the same component, and vice-versa, unless explicitly stated otherwise herein. Moreover, the applicant does not intend for any term in the specification or claims to be ascribed an uncommon or special meaning unless explicitly set forth as such. Further, the present subject matter encompasses present and future known equivalents to the known components referred to herein by way of illustration.

Although the present disclosure provides a description of a portable, interchangeable and multipurpose backpack, it is to be further understood that numerous changes may arise in the details of the embodiments of the backpack. It is contemplated that all such changes and additional embodiments are within the spirit and true scope of this disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure.

It should be understood that the present invention describes a portable, interchangeable and multipurpose backpack providing enhanced storage and a carrier for holding a child. The backpack includes a back plate having a first receptacle for storing items. The back plate includes a face plate receiving section. Further, the back plate includes connecting straps drawing through strap openings. The back plate includes shoulder straps. The backpack includes a face plate having a second receptacle for storing items. The face plate connects to the back plate at the face plate receiving section. The backpack further includes a front plate having front plate strap connectors and top straps. A user puts on the first shoulder straps over his shoulder to use the back plate as a backpack. The front plate strap connectors connect to the connecting straps, and the top straps connect to the first shoulder straps creating a child receiving portion. The user places a child between said back plate and said front plate for use as a carrier for holding a child.

Various features and embodiments of a portable, interchangeable and multipurpose backpack providing enhanced storage and a carrier for holding a child are explained in conjunction with the description of FIGS. 1-15B.

The present invention discloses a portable, interchangeable and multipurpose backpack providing enhanced storage and a carrier for holding a child, in accordance with one embodiment of the present subject matter. FIG. 1 shows an environment 10 of portable, interchangeable and multipurpose backpack 12 (or simply, backpack 12) worn by user 14. Backpack 12 includes back plate 16, face plate 18 and front plate 20. Each of back plate 16 and face plate 18 provides space for storage, and front plate 20 acts as a child carrier and allows for carrying or holding a child 22 in conjunction with one of back plate 16 and face plate 18.

Figure 2:
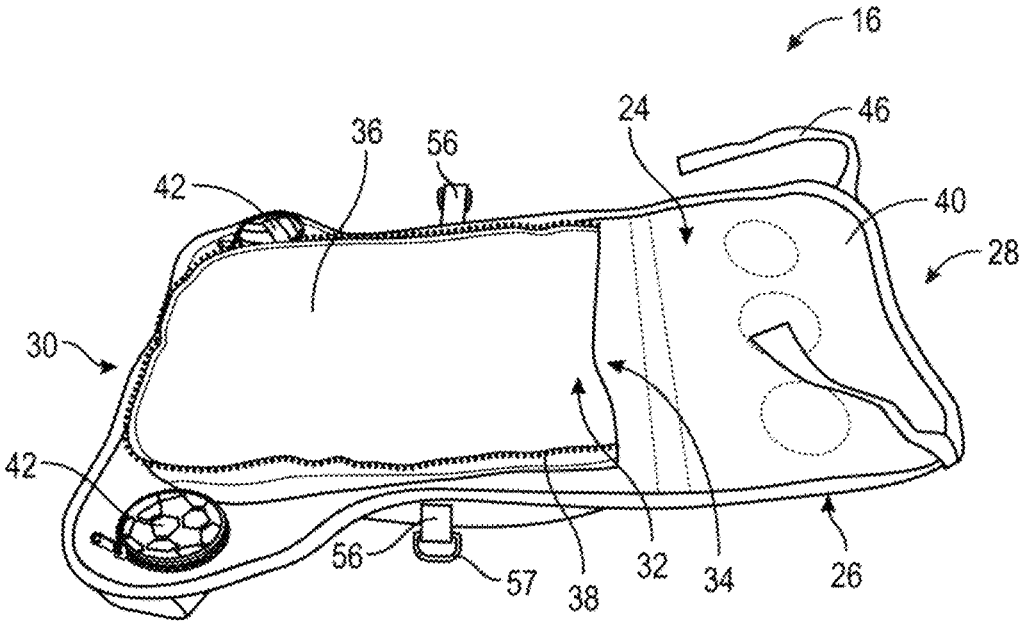
FIGS. 2 and 4 illustrate a side open perspective and a rear view of a back plate, respectively.
Figure 4:
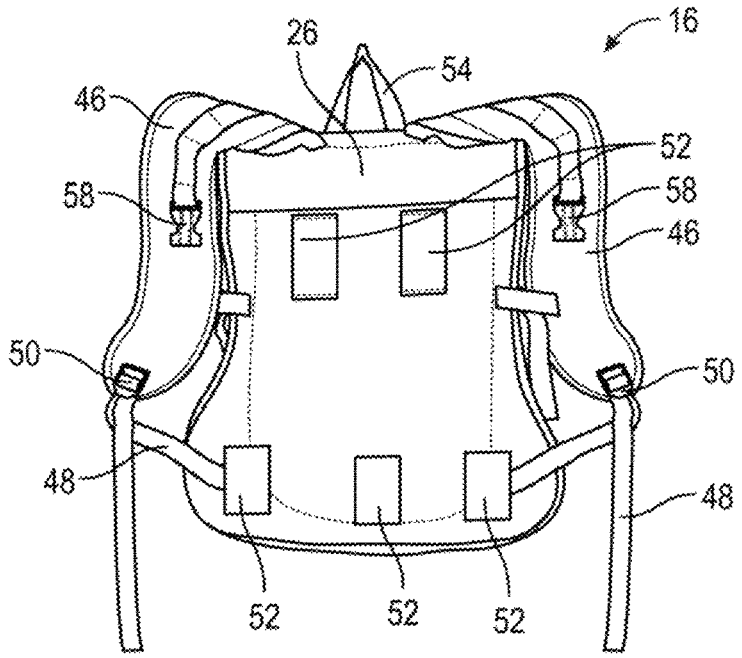

FIGS. 2 and 4 show a side open perspective and a rear view, respectively of back plate 16, in accordance with one embodiment of the present invention. Back plate 16 provides a material made of nylon fabric or molded plastic or any other suitable material. Back plate 16 presents first end 24 and second end 26. First end 24 indicates a front end of back plate 16 and second end 26 indicates a rear end of back plate 16 facing user 14. Further, back plate 16 presents top end 28 and bottom end 30. At first end 24, back plate 16 includes first receptacle or first storage compartment 32 configured for storage. In one example, first receptacle 32 has opening 34 that receives articles or items such as books, clothes or any other items depending on the need. At the outer side, first receptacle 32 includes face plate receiving section 36. Face plate receiving section 36 encompasses zipper 38 extending around it's outer surface.

Further, back plate 16 includes first access section 40. Here, first access section 40 includes a cover flap, slit or any other mode of accessing first receptacle 32. In some embodiments, first receptacle 32 and/or first access section 40 encompasses other mechanisms such as snaps, hook and loops, buttons, magnets, zippers, or any other known and/or convenient fastening mechanisms for selectively engaging to close i.e., allowing and restricting access to first receptacle 32.

Figure 3:
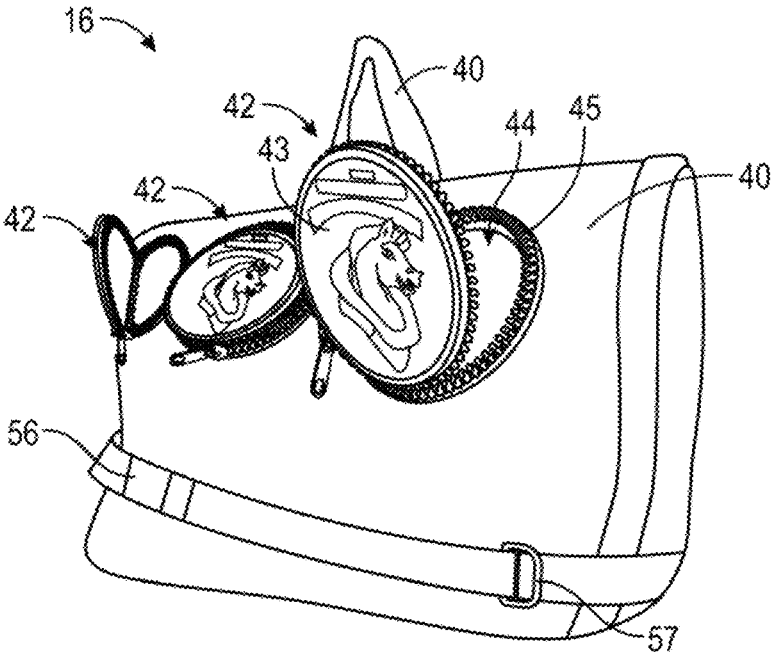
FIG. 3 illustrates a first access section having one or more first portable storage compartments.

In one embodiment, back plate 16 provides one or more first portable storage compartments 42. In one example, one or more first portable storage compartments 42 position at bottom end 30 (FIG. 2). In another example, one or more first portable storage compartments 42 position at top end 28. In one implementation, one or more first portable storage compartments 42 position on first access section 40. FIG. 3 shows a feature of first access section 40 having one or more first portable storage compartments 42. Each of one or more first portable storage compartments 42 acts as a small storage unit and allows to store daily used items and/or other (smaller) items depending on the need. Each of one or more first portable storage compartments 42 can come in a variety of shapes and sizes with varying depth. In one example, one or more first portable storage compartments 42 stores smaller items such as mobile phones, paper bills, currency notes, documents and other items. In one exemplary embodiment, each of one or more first portable storage compartments 42 includes a unique picture or design to provide a visually appealing back plate 16.

Each of one or more first portable storage compartments 42 encompasses opening 44 for receiving the items. Each of one or more first portable storage compartments 42 includes second access section 43. Second access section 43 includes a cover flap, slit or any other mode of accessing first portable storage compartment 42 through opening 44. In one embodiment, first portable storage compartments 42 encompass zipper 45 to close first portable storage compartments 42. In some embodiments, first portable storage compartments 42 encompass other mechanisms such as snaps, hook and loops, buttons, magnets, zippers, or any other known and/or convenient fastening mechanisms for selectively engaging to close storage compartments 42.

Figure 10:
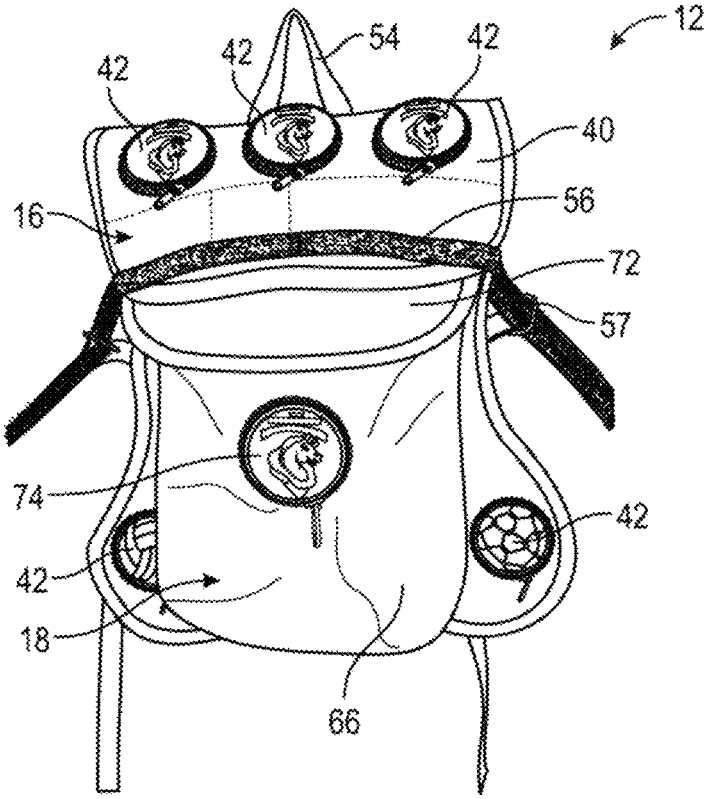
Figure 12:
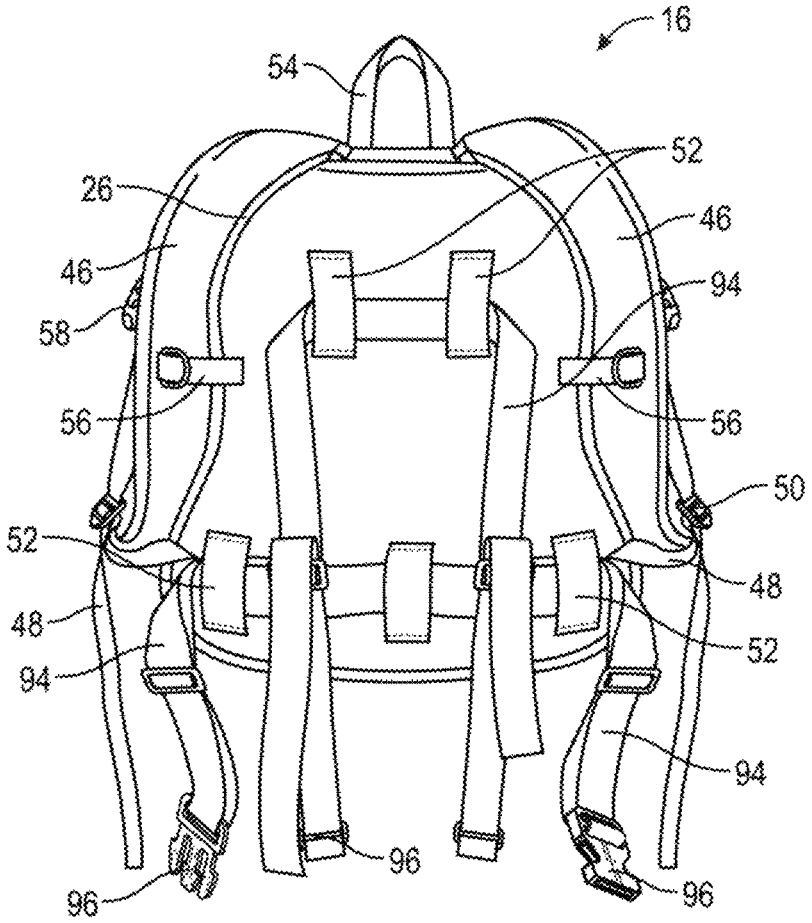
FIG. 12 illustrates a rear view of the back plate receiving connecting straps through strap openings of the back plate.
Figure 14:
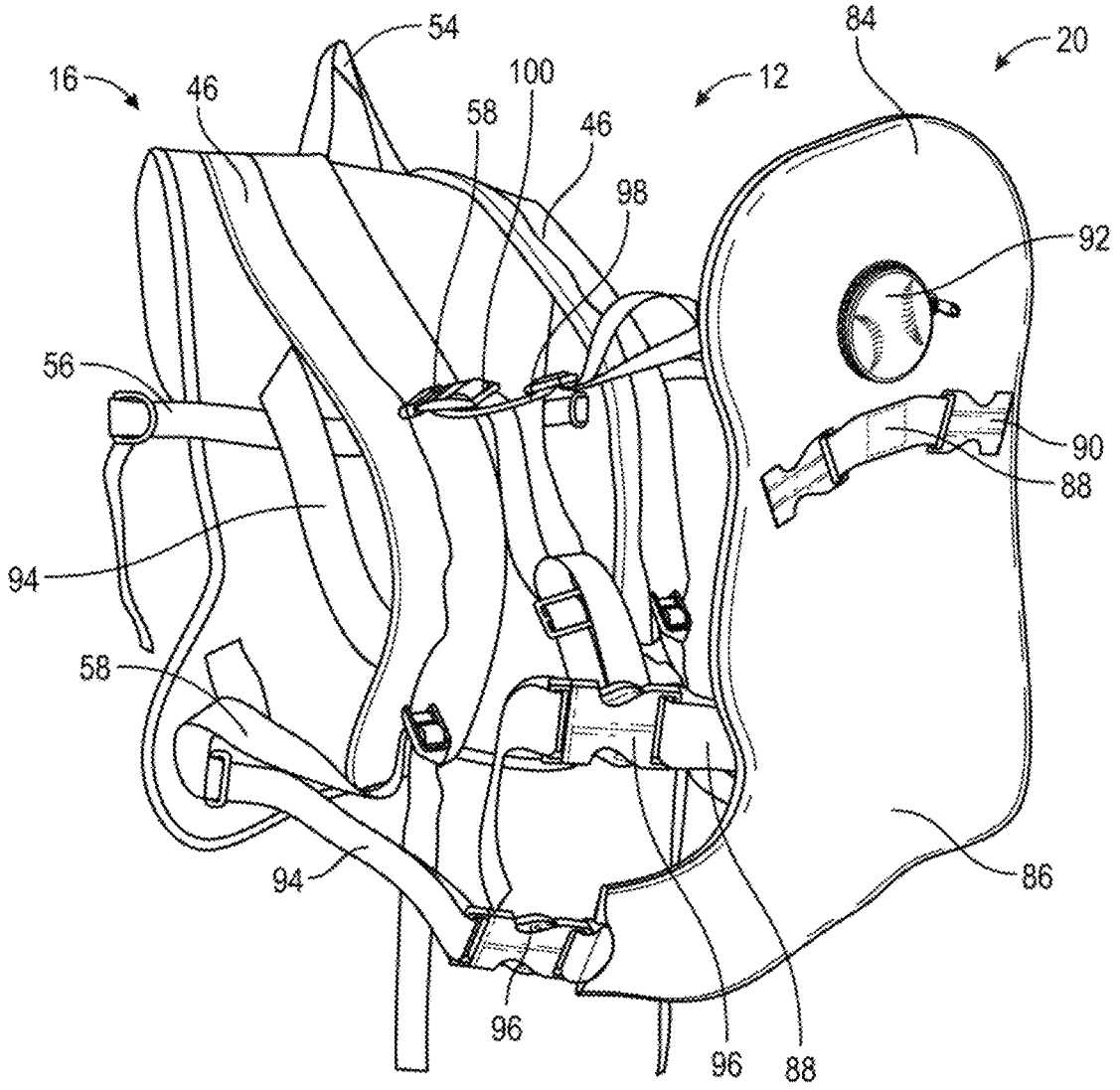
FIG. 14 illustrates the front plate connecting the back plate.

FIG. 4 shows a rear view of back plate 16, in accordance with one embodiment of the present invention. At second end 26, back plate 16 presents first shoulder straps 46. First shoulder straps 46 connect to back plate 16 at top end 28 and includes anchor points 48 that connect at bottom end 30. In one implementation, first shoulder straps 46 present buckle 50 connecting anchor points 48. Anchor points 48 help to adjust the length of shoulder straps 46 through buckle 50. Further, back plate 16 encompasses strap openings 52 at second end 26. Strap openings 52 indicate openings configured for receiving connecting straps 94 for connecting front plate 20 (FIGS. 12 and 14). Further, back plate 16 includes first handle 54 that allows to carry or hang back plate 16. In addition, back plate 16 includes face plate connecting strap 56. Face plate connecting strap 56 extends from first end 24 or second end 26 and helps to secure face plate 18 to back plate 16 (FIGS. 3 and 10). In one example, face plate connecting strap 56 includes D-ring 57 that helps to adjust the length of face plate connecting strap 56. In one implementation, first shoulder straps 46 include front plate connecting buckle 58 that receives top strap 98 to connect front plate 20 to back plate 16.

Figure 5A:
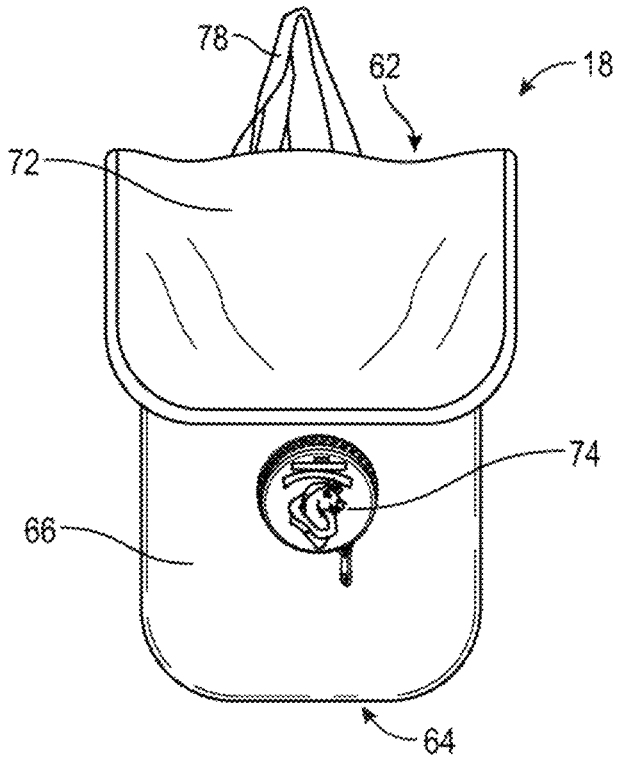
FIGS. 5A and 5B illustrate a top view and a side view of a face plate, respectively.
Figure 7:
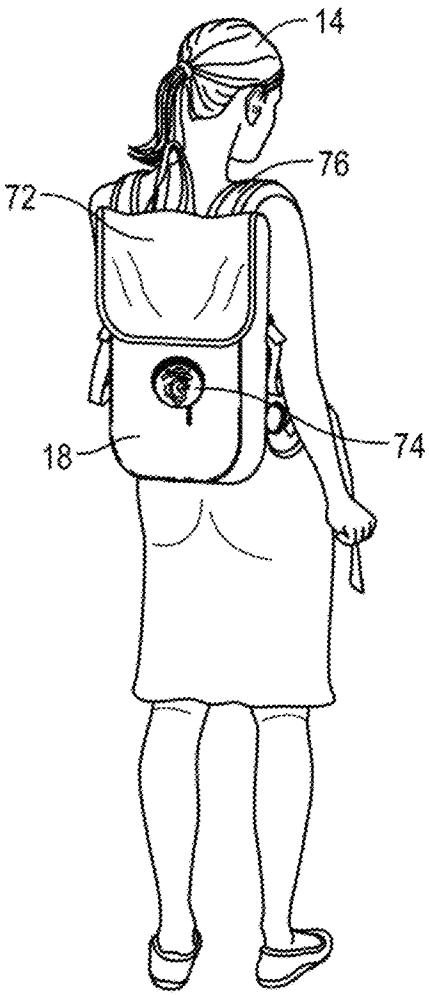
FIG. 7 illustrates a rear perspective view of a user putting on the face plate over his shoulder to use it as a standalone backpack.
Figure 5B:
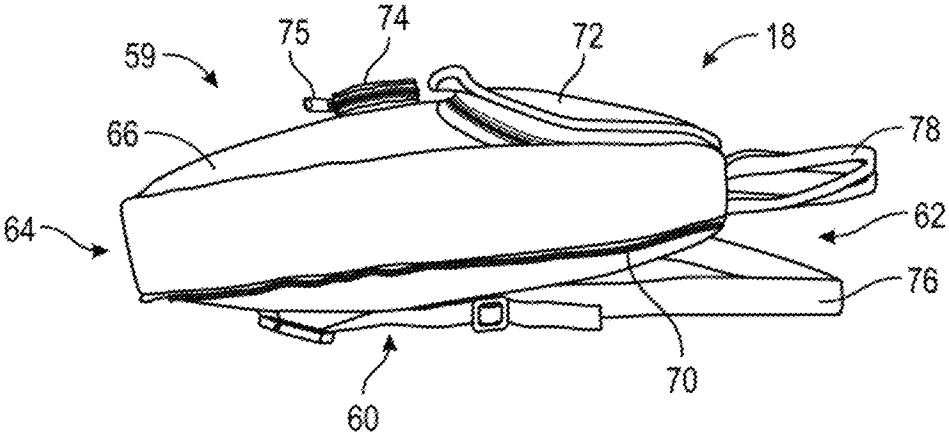
Figure 6:
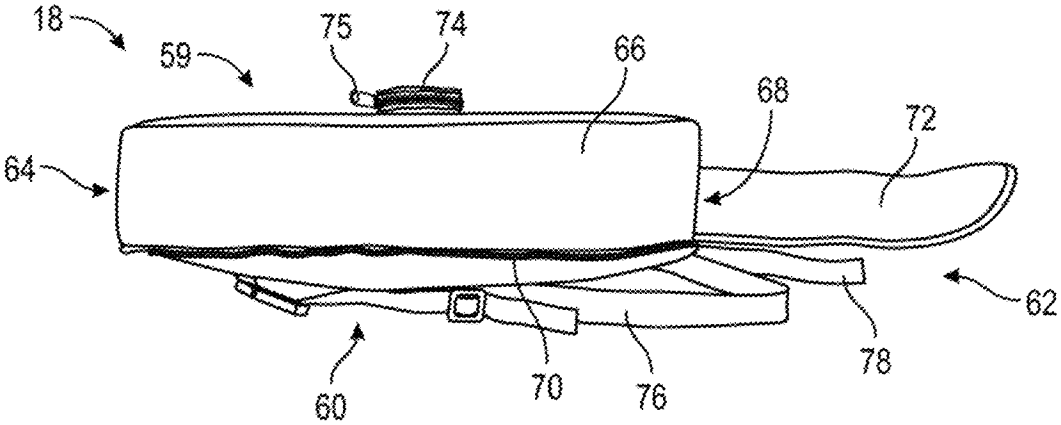
FIG. 6 illustrates a side open view of the face plate.
Figure 11:
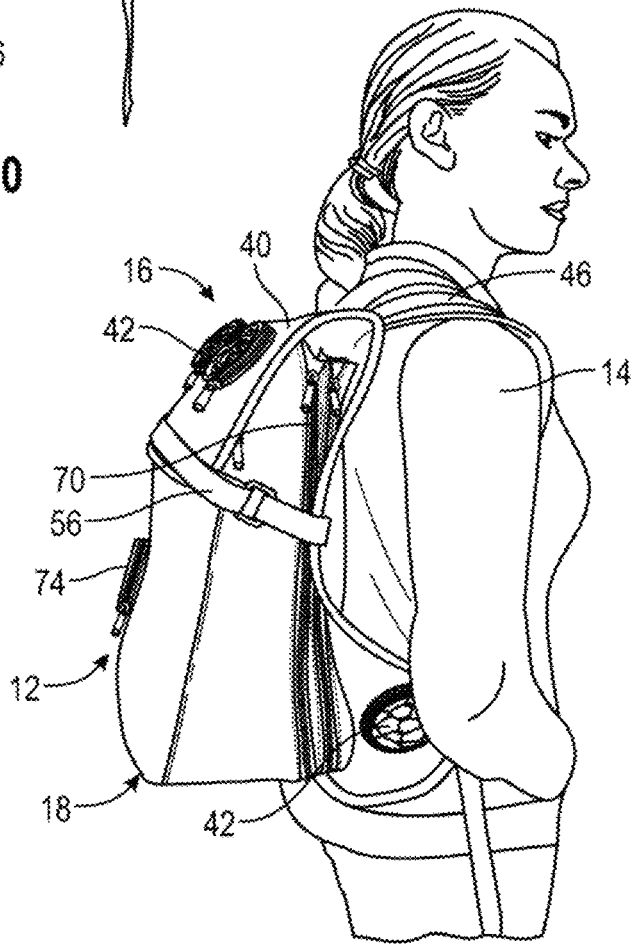
FIG. 11 illustrates the user wearing the back plate connecting the face plate as a backpack.

FIGS. 5A and 5B show a top view and side view of face plate 18, respectively in accordance with one embodiment of the present invention. Further, FIG. 6 shows a side open view of face plate 18. Face plate 18 provides a material made of nylon fabric or molded plastic or any other suitable material. Face plate 18 presents third end 59 and fourth end 60. Third end 59 indicates a front end of face plate 18 and fourth end 60 indicates a rear end of face plate 18 that faces back plate 16 when connected to back plate 16 (FIG. 1) or faces user 14 when used as a standalone backpack (FIG. 7). Further, face plate 18 presents top end 62 and bottom end 64. At first end 59, face plate 18 includes second receptacle 66 configured for storing items such as books, lunch box, and other daily used items. In one example, second receptacle 66 encompasses opening 68 to receive books, clothes or any other items depending on the need. At fourth end 60, second receptacle 66 encompasses zipper 70 extending around it's outer surface (FIG. 5B). Zipper 70 connects to zipper 38 on back plate 16 and allows to use face plate 18 and back plate 16 as a backpack (FIG. 11).

Further, face plate 18 includes third access section 72. Here, third access section 72 includes a cover flap, slit or any other mode of accessing second receptacle 66. In some embodiments, second receptacle 66 and/or third access section 72 encompasses other mechanisms such as snaps, hook and loops, buttons, magnets, zippers, or any other known and/or convenient fastening mechanisms for selectively engaging to close second receptacle 66.

In one embodiment, face plate 18 provides second portable storage compartment 74 at third end 59 (FIGS. 5B and 6). Second portable storage compartment 74 comes in a variety of shapes and sizes with varying depth. Second portable storage compartment 74 acts as a smaller pocket for storing smaller items through an opening (not shown). In one exemplary embodiment, second portable storage compartment 74 includes a unique picture or design to provide visually appealing face plate 18. Second portable storage compartment 74 includes zipper 75. Zipper 75 selectively engages and provides access to interior/opening of second portable storage compartment 74.

Face plate 18 presents second shoulder straps 76 (FIGS. 5B and 6). Second shoulder straps 76 include belt straps or cables/threads that help to carry face plate 18 over the user's shoulders. FIG. 7 shows a rear perspective view in which user 14 puts on face plate 18 over his shoulder to use it as a standalone backpack. In one example, face plate 18 includes handle 78 that allows to carry or hang face plate 18.

Figure 8:
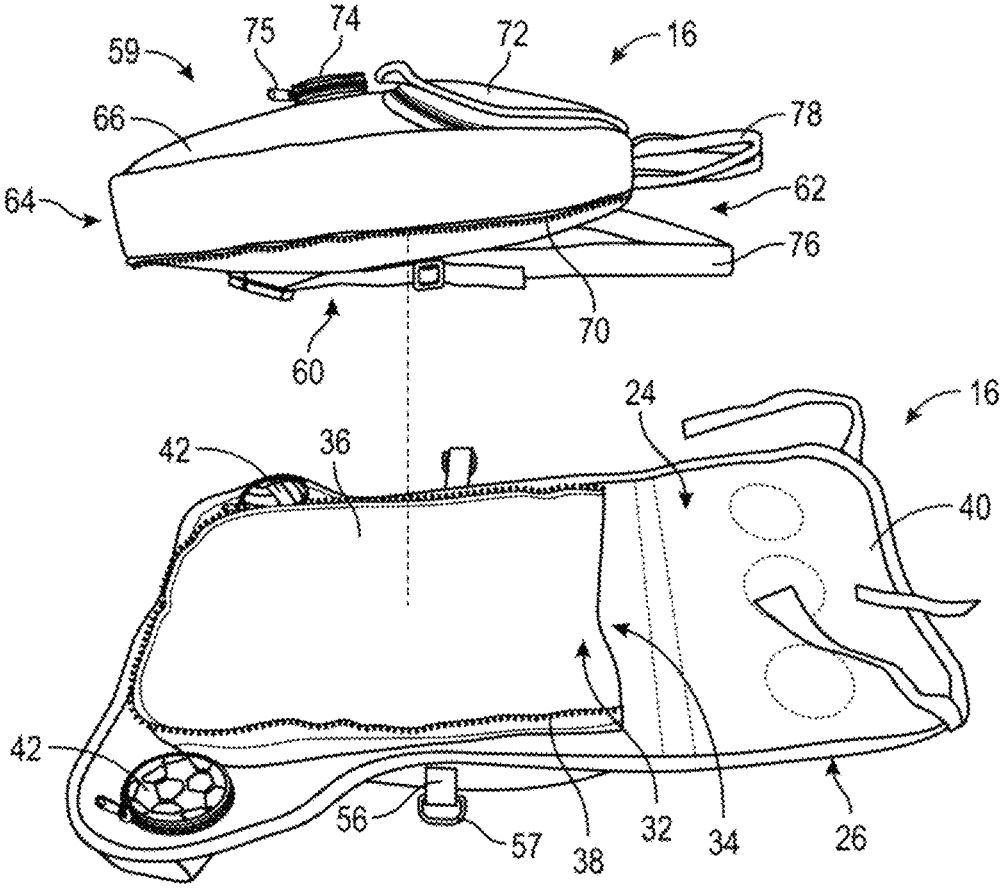
FIG. 8 illustrates the face plate aligned with the back plate.
Figure 9:
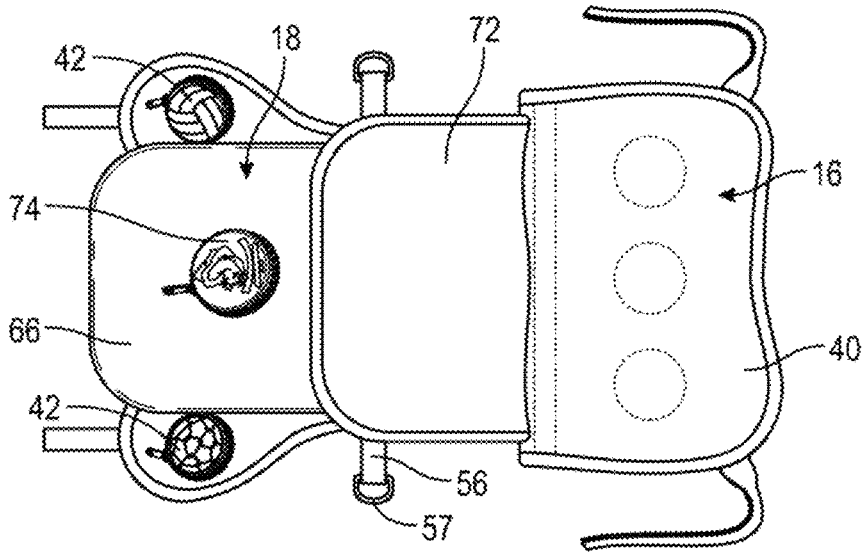
FIGS. 9 and 10 illustrate a top view and a front view of the face plate, respectively, connected to the back plate.

FIG. 8 shows a feature of face plate 18 aligned with back plate 16 for connecting them together. Here, face plate 18 positions over and aligns with face plate receiving section 36 of back plate 16. Subsequently, face plate 18 sits at face plate receiving section 36 and zipper 70 connects with zipper 38 in order to connect face plate 18 to back plate 16. FIG. 9 shows a top view of face plate 18 placed over back plate 16 in which first access section 40 is in an open position. FIG. 10 shows a front view of face plate 18 placed over back plate 16 and first access section 40 in a closed position. Here, first access section 40 positions over second access section 72 and face plate connecting strap 56 tightens over it to keep/secure face plate 18 to back plate 16.

A person skilled in the art understands that back plate 16 and face plate 18 when connected together provide additional space for storage through respective first receptacle 32 and second receptacle 66. Further, back plate 16 and face plate 18 take the shape of a backpack and allows user 14 to use them as a backpack with additional storage (FIG. 11). Whenever user 14 wishes to carry fewer items, then user 14 can uninstall face plate 18 from back plate 16 and use face plate 18 as a standalone backpack as shown in FIG. 7. Similarly, user 14 can use back plate 16 as a standalone backpack. This way, user 14 can interchange and use back plate 16 and/or face plate 18 depending on the need. In one example, face plate 18 can come in a variety of shapes and sizes. As such, user 14 can select face plate 18 for each day or occasion and use it as a standalone backpack. Further, user 14 can combine different designs of face plate 18 with back plate 16 to present visually appealing backpack 12.

FIG. 12 shows a rear view of back plate 16 receiving connecting straps 94 through strap openings 52 of back plate 16. As can be seen, connecting straps 94 draw through strap openings 52 and extend from back plate 16. Each of connecting straps 94 includes buckle 96.

Figure 13B:
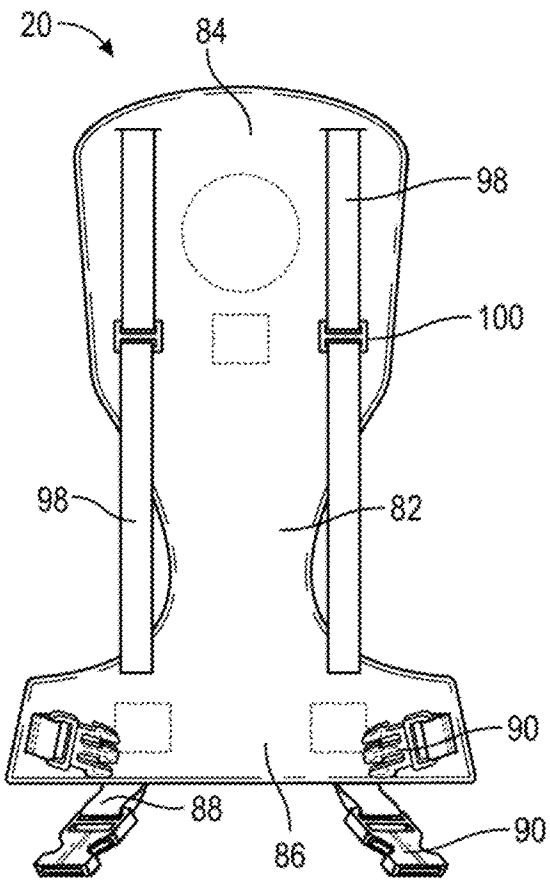
FIGS. 13A and 13B illustrate a front and rear view of a front plate, respectively.
Figure 13A:
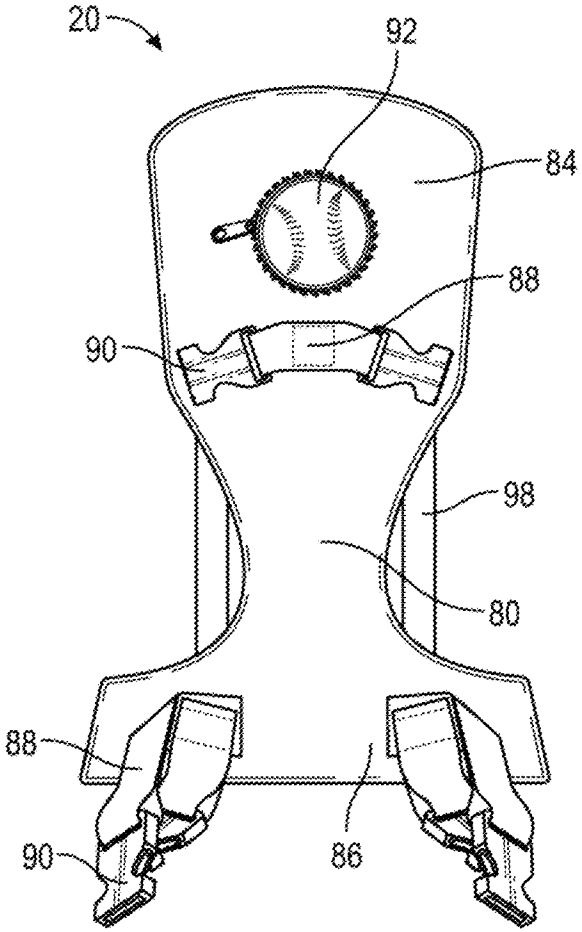

FIGS. 13A and 13B show a front and rear view of front plate 20, respectively. Front plate 20 provides a material made of linen or other fabric or cloth or cushion materials used to wrap and hold child 20 against user 20 (mother, for example). Front plate 20 present fifth end 80 and sixth end 82. Fifth end 80 indicates a front end of front plate 20 and sixth end 82 indicates a rear end of front plate 20. Further, front plate 20 presents top end 84 and bottom end 86. At fifth end 80, front plate 20 provides front plate strap connectors 88 having buckle 90. Front plate strap connectors 88 connect to connecting straps 94 that draw through strap openings 52 of back plate 16. Here, buckles 90, 96 allow connecting front plate 20 to back plate 16.

In addition, front plate 20 includes third portable storage compartment 92 at fifth end 80 (FIG. 13A). Third portable storage compartment 92 comes in a variety of shapes and sizes with varying depth. Third portable storage compartment 92 stores daily used items or other items as per user's need. In one exemplary embodiment, third portable storage compartment 92 includes a unique picture or design to provide visually appealing front plate 20. Further, front plate 20 encompasses top straps 98 extending from sixth end 82. Top straps 98 include buckles 100 that connect to front plate connecting buckles 58 on first shoulder straps 46 of back plate 16. FIG. 14 shows a feature of front plate 20 connecting back plate 16. As can be seen, top straps 98 connect to front plate connecting buckles 58 on first shoulder straps 46 of back plate 16 via buckle 100. Further, connecting straps 94 connect to front plate strap connectors 88 via buckles 90, 96.

Figure 15A:
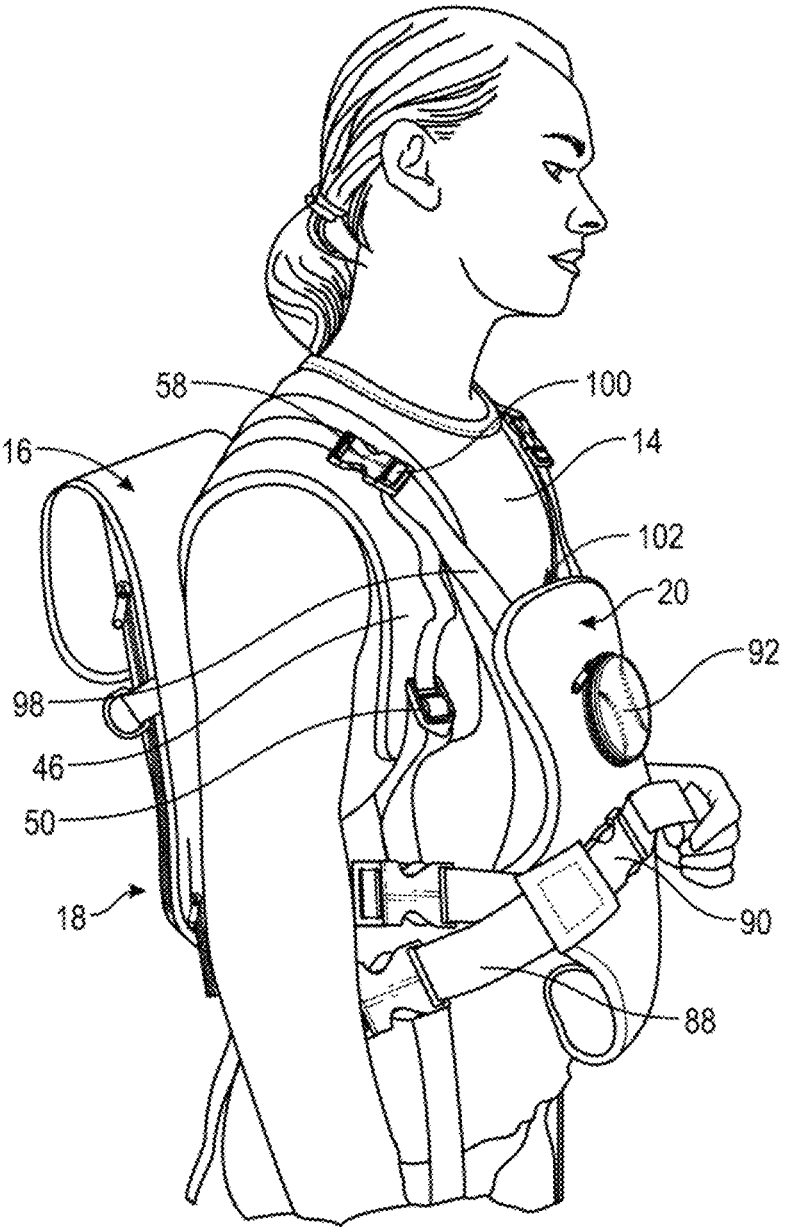
FIGS. 15A and 15B illustrate a side perspective view and a front view of the user wearing the backpack, respectively.
Figure 15B:
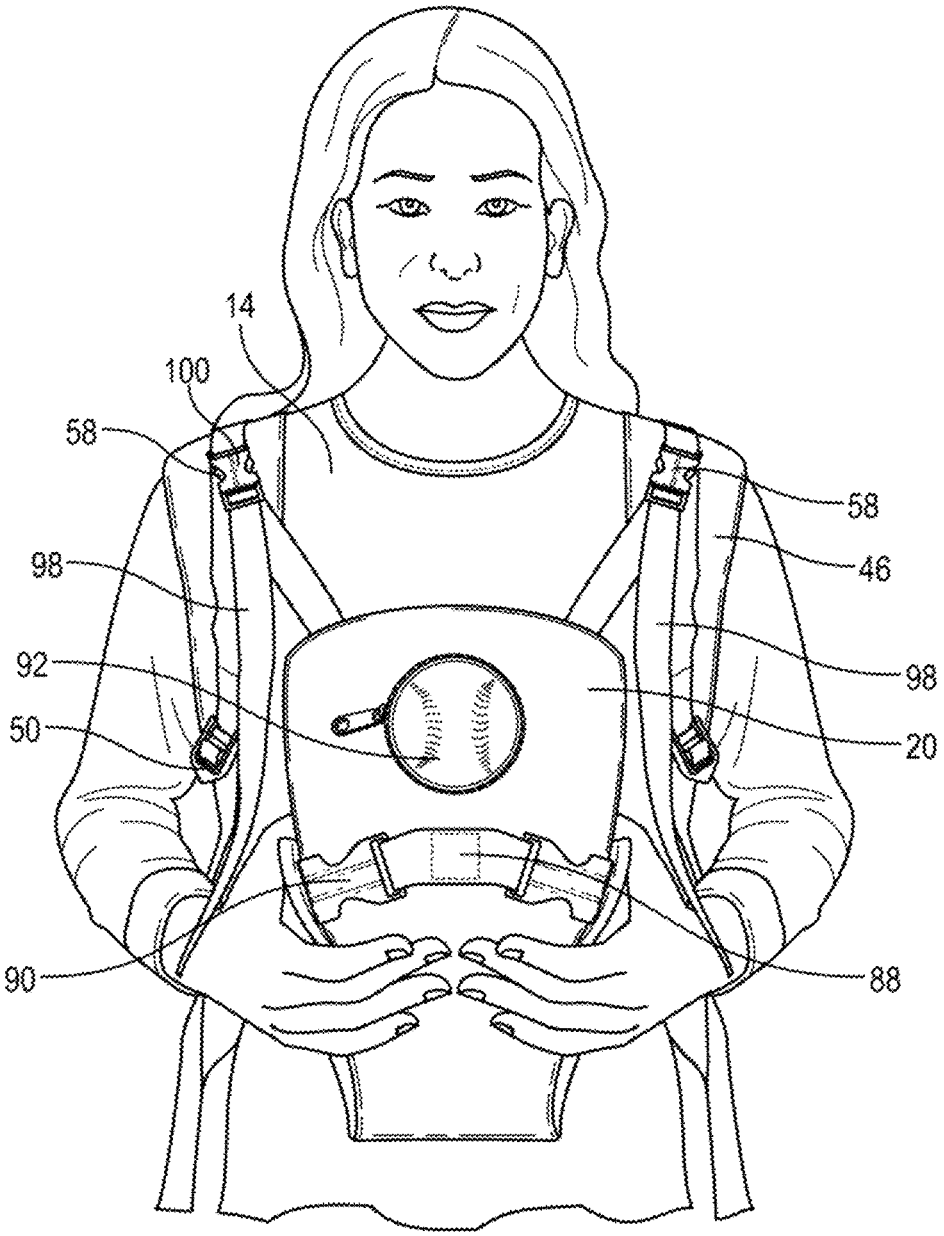

FIGS. 15A and 153 shows a side perspective view and a front view of user 14 wearing backpack 12, in accordance with one exemplary embodiment of the present invention. Here, user 14 puts on or wears back plate 16 over his shoulders and connects front plate 20 to back plate 16. User 14 adjusts the length of connecting straps 94 and top straps 98 depending on the need. When user 14 connects front plate 20 to back plate 16, front plate 20 defines child receiving portion or opening 102. Child receiving portion 102 creates sufficient space for receiving child 22 between user's body and sixth end 82 of front plate 20. Front plate 20 allows holding child 20 in skin-to-skin contact with user 14 between child 22 and user 14 (e.g., mother), such that the user's body provides warmth to child 22.

From the above, a person skilled in the art understands that back plate 16 can be used as a standalone backpack. Further, face plate 18 can connect to back plate 16 and allow user 14 to use it as an alternate backpack with additional storage with first receptacle 32 and second receptacle 66. In one example user 14 can fold and store front plate 20 in first receptacle 32 and/or second receptacle 66.

When needed, user 14 can use front plate 20 and connect to back plate 16 such that he can use back plate 16 as a backpack and front plate 20 as a carrier (or child carrier) for holding a child. This allows backpack 12 to provide dual-functionality of carrying items with back plate 16 and holding child 22 with the help of front plate 20. Additionally, user 14 can connect face plate 18 to back plate 16 and store more items in second receptacle 66 (FIG. 1).

Although it is shown that front plate 20 connects to back plate 16, it is obvious to a person skilled in the art to provide second shoulder straps 76 with a buckle on face plate 18 that connects to top straps 98 of front plate 20. In such an implementation, connecting straps 94 position at fourth end 60 of face plate 18 (similar to connecting straps 94 on back plate 16) for connecting front plate 20 directly to face plate 18. Here, user 14 puts on face plate 18 on his shoulders using second shoulder straps 76 (FIG. 7) and connects front plate 20 to face plate 18. Such an implementation allows to use front plate 20 in conjunction with face plate 18 as a backpack and to carry child 20 with support from front plate 20 without the need for back plate 16. From the above, a person skilled in the art understands that front plate 20 connects to back plate 16 or face plate 18 as needed thereby allowing user 14 to use them interchangeably to use backpack as a standalone backpack (only back plate 16 or only face plate 18 or combination of back plate 16 and face plate 18) or backpack with child carrier (front plate 20 connecting back plate 16 (with or without face plate 18) or front plate 20 connecting face plate 18) depending on the need. This allows backpack 12 having back plate 16, face plate 18 and front plate 20 to use them interchangeably depending on the need.

When it is not required to use front plate 20 for holding child 22, then user 14 uninstalls front plate 20 from back plate 16 or face plate 18 and stores front plate 20 in one of back plate 16 and face plate 18. This saves space and ensures no additional bags are needed to carry the child carrier. Further, user 14 can retain the shape of back plate 16 or face plate 18 and bear the weight of backpack 12 and its contents without any discomfort. Further, this ensures backpack 12 is portable and easy to carry without the need for separate bags.

Based on the above, a person skilled in the art understands that the presently disclosed backpack provides enhanced storage with both back plate and face plate and a carrier i.e., front plate connecting the back plate or face plate for holding a child.

Figure 16:
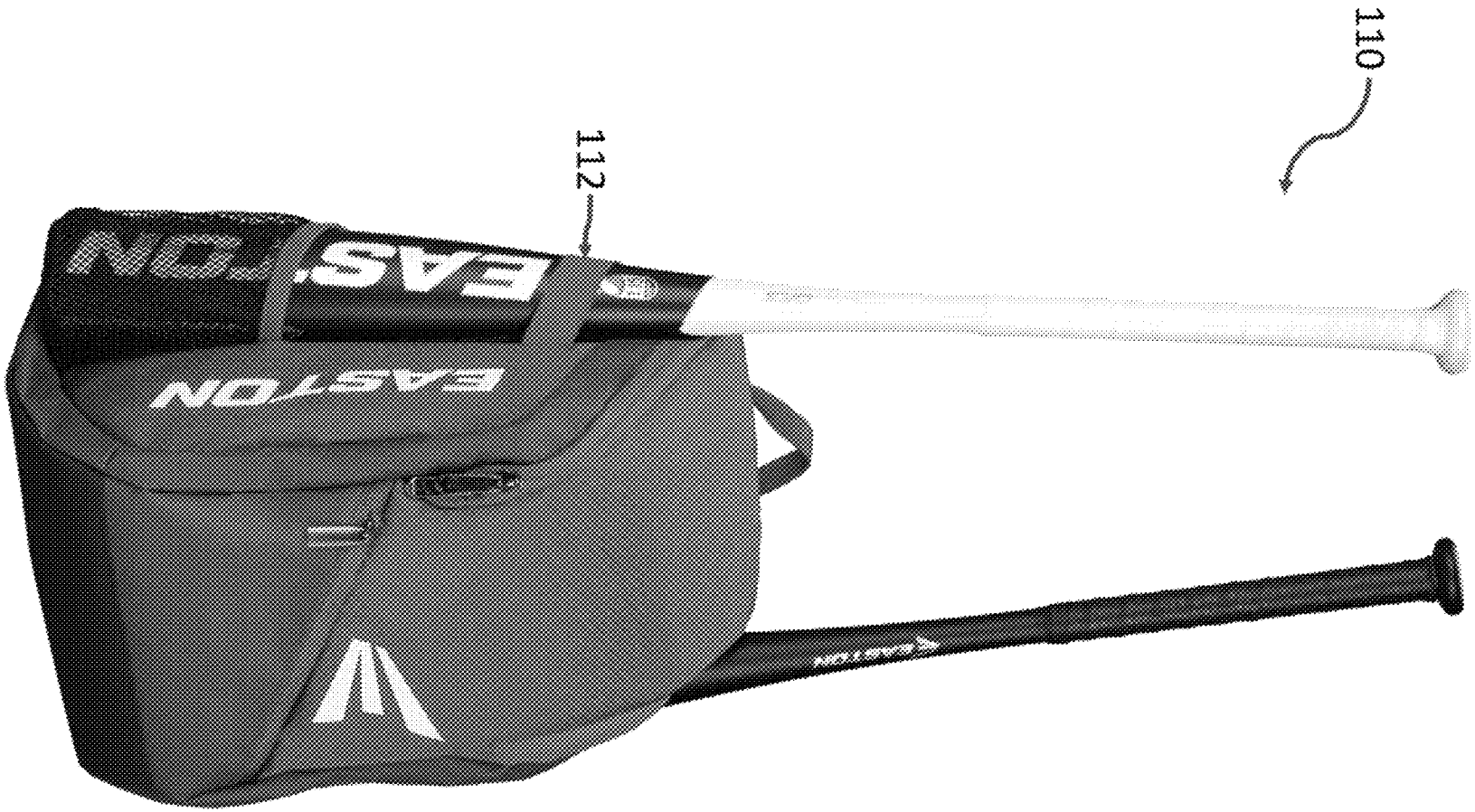
FIG. 16 shows a set of baseball bat holders on the side of one embodiment of the backpack as they may be sewn on the presently disclosed portable, interchangeable and multipurpose backpack.

FIG. 16 shows a set of baseball bat holders on the side of one embodiment of the backpack as they may be sewn on the presently disclosed portable, interchangeable and multipurpose backpack 110. The embodiment 110 of FIG. 16 includes backpack 110 holding the baseball bats. The faceplate will have similar side holders for baseball bats.

Replaceable backpack straps 112 on the backplate solves a problem with backpack straps for large people and short people. With the addition of replaceable straps onto the back of backpack 110, a person 5'0" could purchase a small pair and a 6'0" could purchase a large pair. So, basically, backpack 110 may be with sewn on straps 112 as one embodiment and as well as providing for the manufacture of backpack 110 with a totally "pick-and-put-on" configuration. As such, a student will be able to walk in a store or go online and choose the three different parts of backpack 110 and put them together (backplate, faceplate, straps).

In the above description, numerous specific details are set forth such as examples of some embodiments, specific components, devices, methods, in order to provide a thorough understanding of embodiments of the present disclosure. It will be apparent to a person of ordinary skill in the art that these specific details need not be employed, and should not be construed to limit the scope of the disclosure.

It shall be appreciated that the components of the backpack described in several embodiments herein may comprise any alternative known materials in the field and be of any colour, size and/or dimensions. It shall be appreciated that the components of the backpack described herein may be manufactured and assembled using any known techniques in the field. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

The foregoing description of embodiments is provided to enable any person skilled in the art to make and use the subject matter. Various modifications to these embodiments will be readily apparent to those skilled in the art, and the novel principles and subject matter disclosed herein may be applied to other embodiments without the use of the innovative faculty. The claimed subject matter set forth in the claims may not intended to be limited to the embodiments shown herein, but is to be accorded the widest scope consistent with the principles and novel features disclosed herein. It is contemplated that additional embodiments are within the spirit and true scope of the disclosed subject matter.

What is claimed is:

1. A backpack providing enhanced storage and a carrier for holding a child, said backpack comprising:

a back plate having a first end and a second end, wherein said back plate comprises a first receptacle for storing items, wherein said back plate comprises first shoulder straps and anchor points extending from said second end of said back plate, wherein said first shoulder straps extend from the top of said back plate and said anchor points extend from the bottom of said back plate, wherein said back plate comprises strap openings, and wherein said strap openings are positioned at the top and the bottom of said back plate at said second end;

a front plate comprising front plate strap connectors and top straps; and connecting straps, wherein said connecting straps draw through said strap openings, wherein a user connects said first shoulder straps and said anchor points and puts said first shoulder straps over his shoulder to use said back plate as a backpack, and wherein said front plate strap connectors connect to said connecting straps, and said top straps connect to said first shoulder straps creating a child receiving portion, and wherein the user places a child in said child receiving portion between his body and said front plate for use as a carrier for holding the child.

2. The backpack of claim 1, wherein said back plate comprises a first access section allowing and restricting access to said first receptacle.

3. The backpack of claim 1, further comprising a face plate, and wherein said face plate comprises a second receptacle for storing items and provides enhanced storage with said back plate.

4. The backpack of claim 3, wherein said back plate comprises a face plate receiving section for receiving said face plate.

5. The backpack of claim 4, wherein said face plate and said face plate receiving section connect via a zipper.

6. The backpack of claim 3, wherein said back plate comprises a face plate connecting strap to secure said face plate to said back plate.

7. The backpack of claim 3, wherein said face plate comprises second shoulder straps allowing the user to use said face plate as a backpack independently from said back plate.

8. The backpack of claim 3, wherein said face plate comprises a second access section allowing and restricting access to said second receptacle.

9. The backpack of claim 3, wherein each of said back plate, said face plate and said front plate comprises a portable storage compartment for storing items.

10. The backpack of claim 1, wherein each of said back plate and said front plate comprises a portable storage compartment for storing items.

11. A backpack providing enhanced storage and a carrier for holding a child, said backpack comprising:

a back plate having a first end and a second end, wherein said back plate comprises a first receptacle for storing items, wherein said back plate comprises a face plate receiving section at said first end, wherein said back plate comprises first shoulder straps and anchor points extending from said second end of said back plate, wherein said first shoulder straps extend from the top of said back plate and said anchor points extend from the bottom of said back plate, wherein said back plate comprises strap openings, and wherein said strap openings are positioned at the top and the bottom of said back plate at said second end;

a face plate having a first end and a second end, and wherein said face plate comprises a second receptacle for storing items;

a front plate comprising front plate strap connectors and top straps; and connecting straps, wherein said connecting straps draw through said strap openings of said back plate, wherein a user connects said first shoulder straps and said anchor points and puts said first shoulder straps over his shoulder to use said back plate as a backpack, wherein said face plate connects to said back plate at said face plate receiving section and provides enhanced storage with said back plate; and wherein said front plate strap connectors connect to said connecting straps, and said top straps connect to said first shoulder straps creating a child receiving portion, and wherein the user places in said child receiving portion a child between his body and said front plate for use as a carrier for holding a child.

12. The backpack of claim 11, wherein said back plate comprises a first access section allowing and restricting access to said first receptacle, and said face plate comprises a second access section allowing and restricting access to said second receptacle.

13. The backpack of claim 11, wherein said face plate comprises second shoulder straps allowing the user to use said face plate as a backpack independently from said back plate.

14. The backpack of claim 11, wherein each of said back plate, said face plate and said front plate comprises a portable storage compartment for storing items.

15. The backpack of claim 11, wherein said back plate comprises a face plate connecting strap to secure said face plate to said back plate.

16. A method of providing a backpack for enhanced storage and holding a child, said method comprising steps of:

providing a back plate having a first end and a second end, said back plate comprising a first receptacle for storing items, said back plate comprising first shoulder straps and anchor points extending from said second end of said back plate, said first shoulder straps extending from the top of said back plate and said anchor points extending from the bottom of said back plate, said back plate comprising strap openings, said strap openings positioned at the top and the bottom of said back plate at said second end;

providing a front plate comprising front plate strap connectors and top straps;

providing connecting straps drawing through said strap openings of said back plate;

connecting said first shoulder straps and said anchor points to use said back plate as a backpack over a shoulder of a user;

connecting said front plate strap connectors to said connecting straps;

connecting said top straps to said first shoulder straps creating a child receiving portion; and placing a child in said child receiving portion between the user's body and said front plate for use as a carrier for holding the child.

17. The method of claim 16, further comprising:

providing a face plate having a second receptacle for storing items, said face plate connecting to said back plate.

18. The method of claim 17, further comprising:

providing a first access section for said back plate allowing and restricting access to said first receptacle; and providing a second access section for said face plate allowing and restricting access to said second receptacle.

19. The method of claim 17, further comprising:

providing a portable storage compartment for each of said back plate, said face plate and said front plate for storing items.

20. The method of claim 16, further comprising:

providing a portable storage compartment for each of said back plate and said front plate for storing items.

* * * * *